US006435931B1

(12) United States Patent
Yaeger et al.

(10) Patent No.: US 6,435,931 B1
(45) Date of Patent: Aug. 20, 2002

(54) GROUP WALKING TOY

(76) Inventors: Robin Marie Yaeger, 4773 Beach Ridge Rd., Lockport, NY (US) 14094; Roy Robert Ryer, 8086 Tonawanda Creek Rd., East Amherst, NY (US) 14051

( * ) Notice: Subject to any disclaimer, the term of this patent is extended or adjusted under 35 U.S.C. 154(b) by 0 days.

(21) Appl. No.: 09/962,516

(22) Filed: Sep. 25, 2001

Related U.S. Application Data

(60) Provisional application No. 60/265,344, filed on Feb. 1, 2001.

(51) Int. Cl.[7] ..... A63H 33/00

(52) U.S. Cl. ..... 446/29; 448/71; 448/491; 472/133; 273/442

(58) Field of Search ..... 446/71, 72, 73, 446/7, 29, 26, 227, 491; 472/133; 434/247, 258, 237; 482/35, 38; 273/440, 442, 444, 453, 451

(56) References Cited

U.S. PATENT DOCUMENTS 3,933,353 A * 1/1976 Marsh ..... 273/440
4,563,981 A 1/1986 Kramer ..... 119/96
5,291,909 A * 3/1994 Skorman et al. ..... 135/67
5,405,304 A * 4/1995 Petersheim et al. ..... 434/258
5,443,304 A * 8/1995 Fochs ..... 135/67

* cited by examiner

*Primary Examiner*—Jacob K. Ackun
(74) *Attorney, Agent, or Firm*—Michael L. Dunn

(57) ABSTRACT

A mobile toy having a plurality of compartments for containing persons. At least some of the compartments are sized to contain walking children. Each compartment is defined by a sidewall structure having a side opening for ingress and egress and each of the compartments is open at a top and at a bottom. The toy is further provided with means for suggesting an identity that stimulates a child's interest and includes structure for utilizing walking energy of persons within the compartments to cause the toy to move. The toy permits children to be organized for walking from one location to another while simultaneously enjoying a play experience.

20 Claims, 3 Drawing Sheets

GROUP WALKING TOY

CROSS-REFERENCE TO OTHER PATENTS

This patent application claims priority from U.S. Provisional Patent Application Ser. No. 60/265,344 filed Feb. 1, 2001.

BACKGROUND OF THE INVENTION

This invention relates to play and facilitating uniform group mobility, specifically through the use of a toy.

The possibility that a child might wander from a group of their peers, although supervised, exists universally. There has therefore been an ongoing concern as to how to manage groups of young mobile children. This is especially a concern to preschool and day care center personnel during any excursion, whether inside or outside of their facilities. The wandering behavior is generally the result of not being sufficiently stimulated by the task at hand and something else sparks the child's attention. Traditionally, the approach to managing the problem has focused on hardware-based methods and materials. Attempts to control children have involved the use of tethers, buckles, rings and poles. These items have been arranged in a manner to impart directional control through harnesses or safety line systems, e.g. as described in U.S. Pat. No. 4,563,981. Although these measures exist, they are not fully utilized by the populations they are intended to serve. There are many reasons for this lack of use. For example, the nature of such devices can contribute to injuries related to entanglement, pinching, pulling, jarring and tripping. Further, the appearance or mechanics of such devices tends to be perceived as leash-like as in controlling animals. Additionally known devices have been complex, often requiring technically or physically cumbersome set-up or operation. Such known devices may also readily malfunction or become misplaced. As a further disadvantage, small children often do not initially cooperate with a foreign-looking apparatus.

SUMMARY OF THE INVENTION

In accordance with the invention, a playful experience and purposeful way of arranging and maintaining a group of mobile persons in a single-file fashion is therefore provided. Notably, a cohesive group is formed having a common goal to make the invention move or pretend that it is alive. The users are afforded an opportunity to role-play and maximize their imagination as it relates to the identity of the toy. The individuals experience a sense of belonging and achievement. Teamwork is introduced as the group physically moves the toy altogether. Learning to share and decision-making opportunities become available through specific features of the toy. There are socialization benefits. Young and old alike can play together with the toy. Unlike known devices, the group walking toy of the invention is a toy first and foremost. By nature of being a group toy, it serves as a method of grouping individuals in a single-file to move the toy. Unlike the prior art, the group walking toy does not employ tethers, rings, buckles or coils as in harnesses or safety line systems. Materials utilized in the invention are believed to be more acceptable from a safety standpoint. The toy provides better protection against bruises and abrasions than known devices if an unpredictable stumble were to occur. Also, the invention has recognizable qualities that naturally entice the users and do not prompt apprehension or uncooperativeness. Parents and daycare center personnel would view the group walking toy of the invention favorably without any preconceived notions of animal-like control.

Additionally, because of the uncomplicated set-up and operation of the invention, day care and preschool staff would find the group walking toy desirable. Further, the invention can be played with as it rests on the floor without the need for close adult supervision. Furthermore, the group walking toy of the invention has the capacity to keep the users delighted over time by offering a feature to convert the identity or personality of the invention. Therefore, the toy remains popular over time. Toy features that prolong the interest and participation of preschoolers are in demand. Additionally, when an adult supervisor walks with the group, near the perimeter of the toy, they do not necessarily appear to be an authority but one engaged in the fun as well. Additionally, the invention can easily lend itself to be useful as a theatrical prop for elementary-level school plays. The group walking toy of the invention, in addition to school settings, can be utilized within children's camp settings, birthday parties, family reunions or other community events such as fairs and fund-raisers. The toy is relatively simple and could be easily mass-produced. The invention is durable and requires minimal service requirements. Other objects and advantages will become apparent from the ensuing specification and drawings.

More particularly, the invention is a mobile toy having a plurality of compartments for containing persons. At least some of the compartments are sized to contain a walking child. Each compartment is defined by a sidewall structure having a side opening for ingress and egress and each of the compartments is open at a top and at a bottom. The toy is further provided with means for suggesting an identity that stimulates a child's interest and includes structure for utilizing walking energy of persons within the compartments to cause the toy to move.

DETAILED DESCRIPTION OF THE INVENTION

Figure 1:
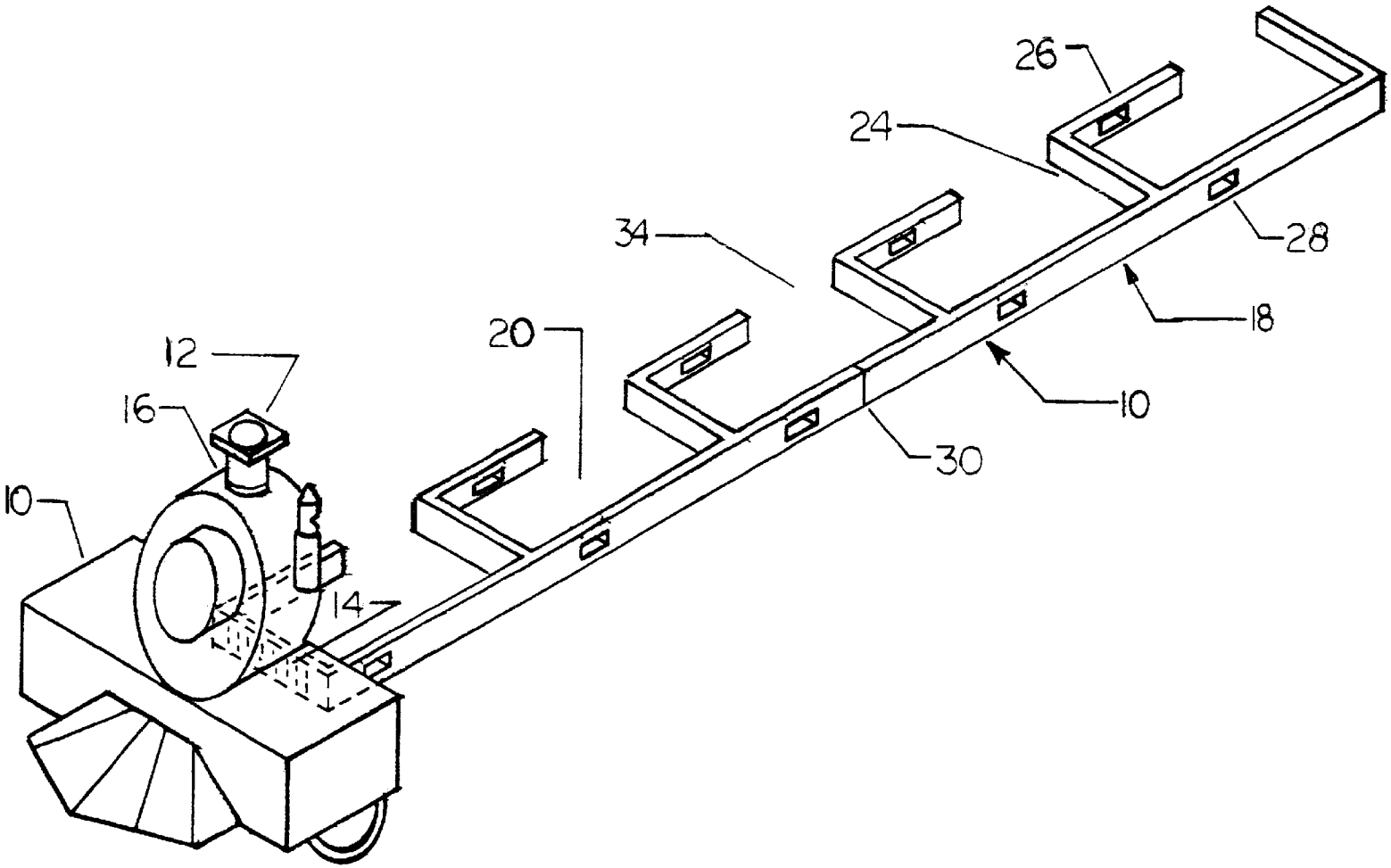
FIG. 1 is a perspective view of the preferred embodiment of the invention.

"Mobile toy" as used herein means a toy that may move from one location to another as it is used and more particularly is intended to mean a toy that essentially surrounds a child as the toy moves. The toy has a plurality of compartments for containing persons, at least some of which of which are sized to contain a walking child and that may be sized to hold an adult.

Compartments for holding children usually have a width dimension (perpendicular to the normal direction of travel of the of toy) of from about 12 to about 18 inches and a depth dimension (parallel to the normal direction of travel) of from about 12 to 20 inches. Compartments for holding adults usually have a width dimension of from about 16 to about 24 inches and a depth dimension of about 16 to about 24 inches. The number of compartments may vary but is more than two and usually less than twelve. The toy may, for example have three through six compartments and be sufficiently light to permit the toy to be easily lifted and transported by children in the compartments or by an adult in a central compartment. The toy may also, for example have a series of five through ten linearly aligned compartments wherein first and last compartments of the series are sized to hold an adult to permit essentially complete control of the toy by the adults.

Each compartment is defined by a sidewall structure having a side opening for ingress and egress and each of the compartments is open at a top and at a bottom. The compartment may be of many shapes as viewed from above, assuming wall extension through the sidewall opening, e.g. curvilinear, such as circular, elliptical, or polygonal such as rectangular or hexagonal. Often, at least one of the compartments is large enough to contain an adult so that the adult can assist with carrying, control and direction of the toy. To assist in carrying and control, a compartment large enough for an adult may pass through the center of gravity of the toy. The toy is thus more easily balanced and directed. The compartments are usually aligned linearly in single file but may be in double file with the openings in the sidewalls of compartments in the same row being in exterior portions of the sidewalls.

The toy is provided with means for suggesting an identity, e.g. an imaginative facsimile of an object, that stimulates a child's interest. Such identities are usually of animate or inanimate elongate normally mobile objects, e.g. animals such as a porpoise, a whale, a shark, a dragon, a snake, an alligator, a caterpillar, a dachshund, or vehicles such as a truck, a bus, a roller coaster or a rocket. The identity could also be the identity of a plurality of aligned objects, e.g. cars of a train, a duck followed by ducklings, a cat followed by kittens, etc. The imaginative facsimile of the object is often at least partly located proximate a front end of the toy (alternatively referred to herein as a "lead character) and defines the identity, e.g. an alligator or shark head or the front end of a vehicle. Such lead characters, assuming ownership approval, could also be well known cartoon or television characters, e.g. those of Disney, Warner Brothers, PBS or the Children's Television Network. A trailing end of the toy may also have suggestive indicia, e.g. the fin of a shark, porpoise, or rocket or the trunk of a vehicle or caboose of a train. In a preferred embodiment, the imaginative facsimile of the object can be altered to suggest different objects, e.g. by exchange with a facsimile of a different object. In addition to the major imaginative facsimile of an object, the toy may also include other structure for providing visual stimulation related to the identity, e.g. placards, drawings, colors, engravings and three dimensional structures and may include structures, e.g. amplifiers, speakers, whistles, horns and tape and CD players for providing auditory stimulation related to the identity.

The means for utilizing walking energy of persons within the compartments to cause the toy to move is usually a plurality of grips or handles for assistance in carrying the object as the persons walk. Such grips or handles are usually rounded and sized for easily wrapping a hand around the grip. Compartments may have different sized grips for use by children and adults and adult grips may be positioned higher on the toy to permit ease of gripping by both adults and children.

The toy may also include structure such as hinges and locks to permit the toy to be collapsed for storage.

The mobile toy of the invention is usually made of lightweight shock absorbing materials such as plastic coated with closed cell plastic foams to form shock absorbing readily cleanable surfaces.

Figure 2:
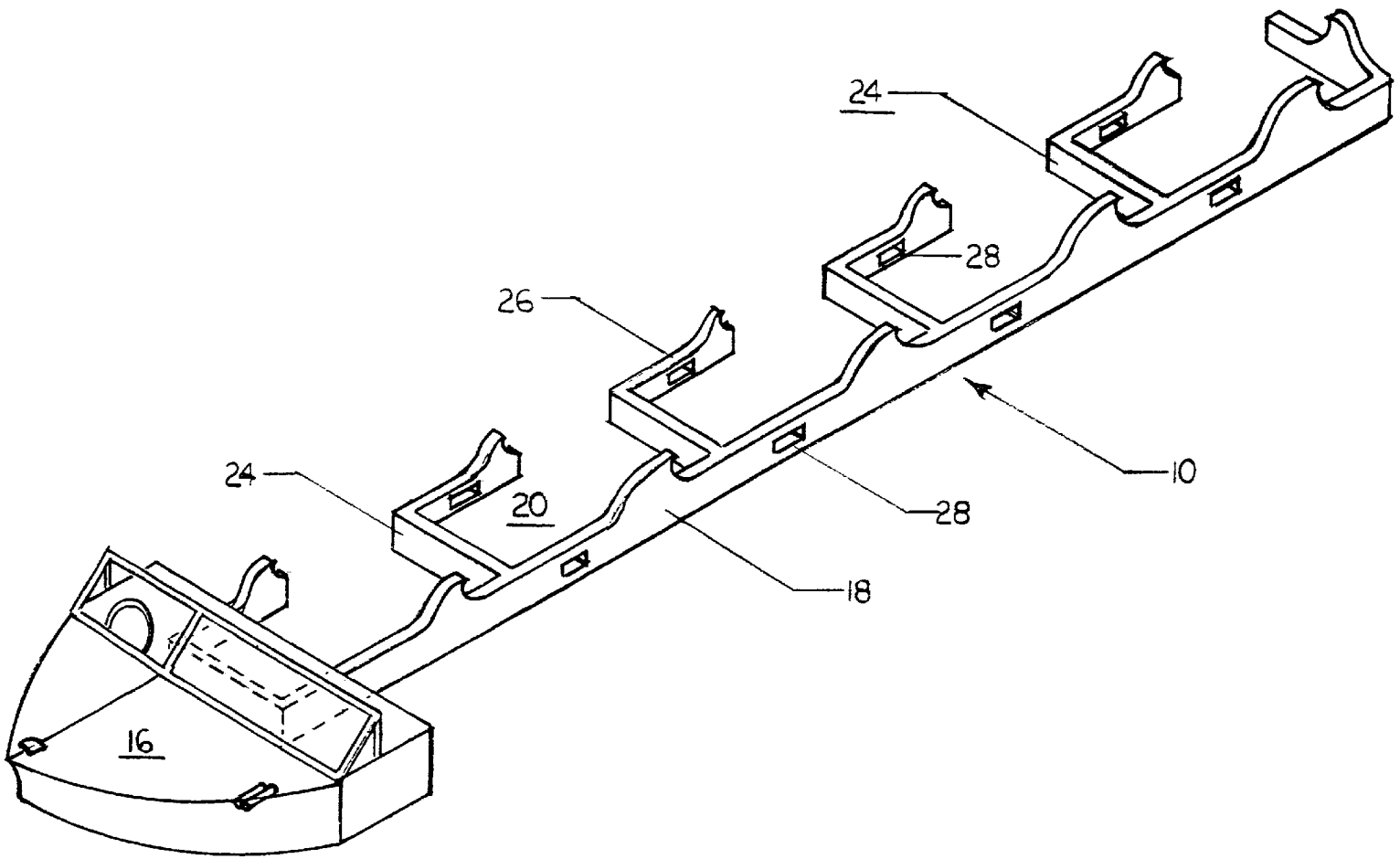
FIG. 2 is a perspective view of an alternative embodiment.
Figure 3:
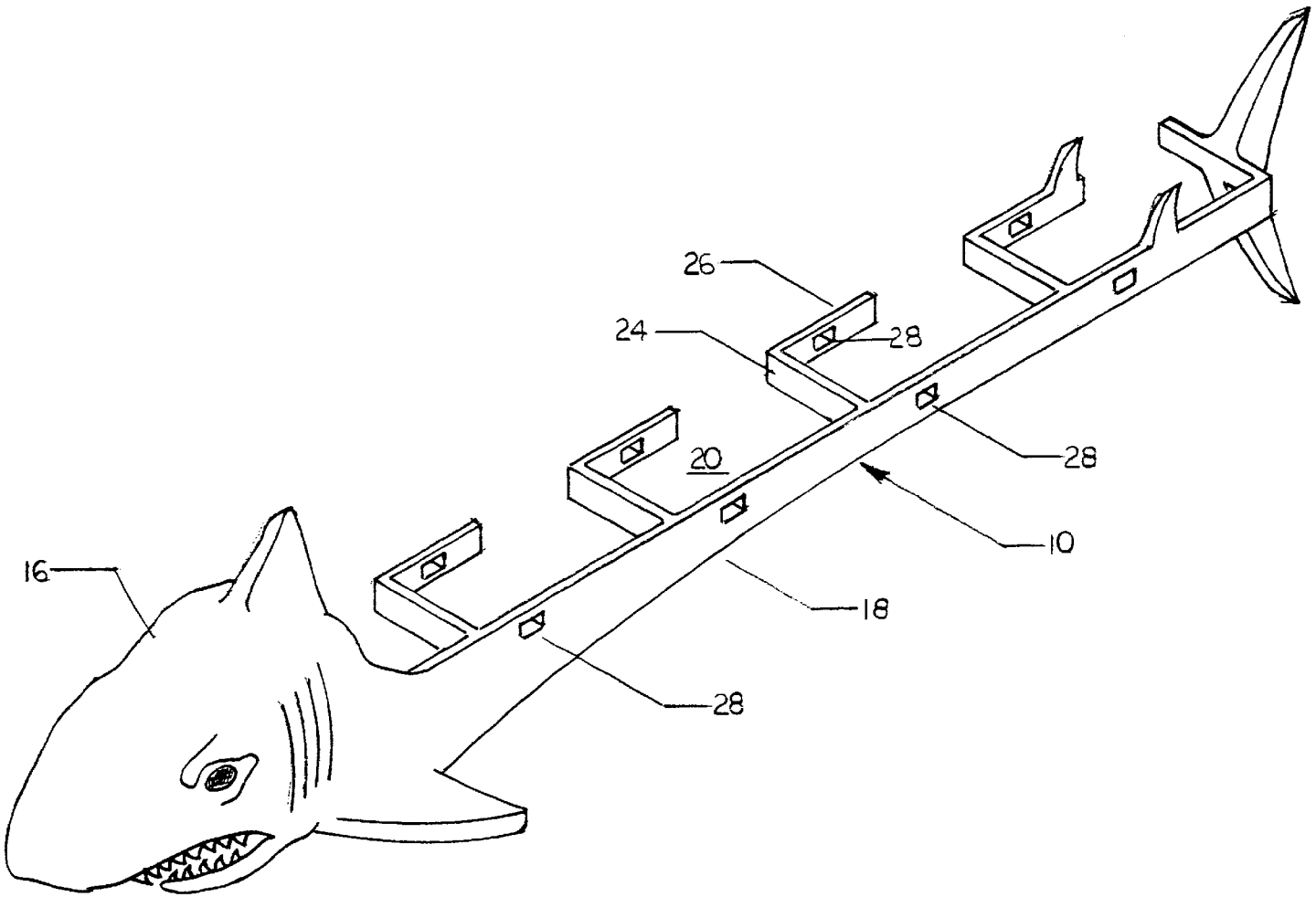
FIG. 3 is a perspective view of an additional alternative embodiment.

A preferred embodiment of the invention is illustrated in FIG. 1. As seen in FIGS. 1–3, a toy of the invention 10 is provided with a frame 18 and a series of compartments 20 which may be sized to contain a walking child, a walking adult or both. The top is provided with an imaginative facsimile of an object, e.g. in the form of a "lead character" 16. The lead character form is one of a multitude of available forms that are three-dimensional simulations of animate or inanimate objects preferably measuring approximately two and a half feet long by two feet wide by two and a half feet high (2½'×2'×2½'). As illustrated in FIG. 1, the lead character 10 suggests a train. A hook and loop fastener 14 is sewn onto the posterior-most surface of the lead character form and onto the anterior-most surface of the frame respectively to permit the lead character to be changed, e.g. into a shark or boat as shown in FIGS. 2 and 3. A switch device 12 is located on the lead character 10 in a strategic location for easy activation by a front-most individual in a compartment 20 to activate auditory or visual devices. An adhesive-backed hook and loop fastener 16 is secured to the underside of the switch device 12 and to the top surface of the lead character form 10 respectively to permit the device to be moved from one lead character to another. As shown in teachings, the toy preferably measures approximately nine and a half feet long by one foot to two feet wide in the compartment 20 by about four inches high. The toy 10 has a single row of rectangular contiguous compartments 20 having access opening 30. Frame 18 acts as a left arm support and serves as the site from which an anterior arm 24, projects perpendicularly to the right about every twenty inches. From the terminal end of each anterior arm, a right side arm 26 projects perpendicularly in a posterior direction parallel to frame 18 almost enclosing individual compartments 20. A rectangular cutout handle 28 appears roughly every twenty inches along the frame and in each side arm 26. Five sets of handles result, one pair per compartment 20. The bilateral cutout handles are positioned approximately one inch below the top surface of the frame 18 and the right side arms 26 leaving narrowed portions of the frame over the cutout handle 28. Frame 18 may be hinged at line 30 near the midpoint of the frame to permit the toy 10 to be folded for storage.

The function of the lead character 10 is to establish the personality or identity of the group walking toy for playing purposes. The indicia and exchangeable capacity of the lead character forms serve to entice children over time. The frame 18 provides for the following: a site of attachment for the loop portion of the hook and loop fastener 14 that is sewn onto the lead character forms 10, a method of promoting the arrangement of the compartments 20 in single file, and a site for the handles 28 bilaterally, the dimensions of the compartment 20 are meant to provide a close, nearly enclosing linear-type boundary for each participant of the group. The lengths of the compartments provide sufficient space for an efficient stride while distant enough from an adjacent group member to avoid any provoking or unwanted collision. The operation of the invention is as follows. A lead character form is chosen and secured to the frame using the hook and loop fastener 14. While the invention rests on the floor, the participants individually step into a compartment 20 and lift the toy in a cohesive manner using the cutout handles 28 bilaterally. The group proceeds to walk. When complimentary sensory stimulation, related to the identity of the lead character 10 is desired, a participant activates an encased switch device 12 located on the lead character 10. When the group is finished playing with the group walking toy, they cooperatively lower the toy onto the floor and step out of their compartments.

In alternative embodiments, a change in the nature of the frame is permitted. This change reflects the inclusion of indicia related to the identity of the lead character. As opposed to being a generic, relatively plain frame for use with any lead character, in this embodiment the toy may be modified with meaningful images and lead characters. For example, the compartment portions of the frame could be provided with simulated wheels for pairing with a tractor-trailer, school bus or a train lead character. Likewise, water waves could be matched up with a boat or a fish, e.g. as may be used with a boat version is illustrated in FIG. 2. Similarly, clouds could be used with a bird or airplane lead character. Again, a frame with smooth up and down curves would blend acceptably with a worm, snake or caterpillar. The advantage of employing such embodiments relates to the mental development of the younger users of the toy. In this form, the toy introduces conceptual relationships between the lead characters and the frame. An additional alternative embodiment seen in FIG. 3 comprises an inseparable lead character combined with a lead character-specific frame. For instance, a lead character simulating the face and neck of a great white shark would be continuous with the frame depicting the body, including the fins and tail. The advantage is a one-unit toy compared to two separate pieces. Another advantage is the enhancement of the perceptual skills for the younger users as specific features unique to a great white shark are displayed throughout the toy.

The function and operation of the parts in the alternative embodiments are minimally changed with the exception of the elimination of the exchangeable capacity of the lead character in FIG. 3. The noteworthy differences lie in the description of the structures.

Accordingly, as described herein, the invention is a new toy that is useful in organizing a group of individuals for walking in straight-line motion. It provides for a playful experience as well as a purposeful method of organizing its users in a single file. As the group congregates within the group walking toy, they remain grouped together for the purpose of sustaining their play with the toy. The invention promotes the development of psychological, social and cognitive skills. Additionally, the group walking toy can be enjoyed by many in a variety of settings such as one's home environment, at community functions and in educational settings. When the invention is used in day care settings for excursions, it is a socially acceptable way to facilitate the maintenance of a single-file group. Moreover, the children can continue to delight in using the invention over time by choosing different lead characters to prompt their role-playing. This approach is helpful for day care staff in obtaining the cooperation of small children whom are easily distracted. Finally, the group walking toy of the invention is a manufacture that can be marketed to several audiences to serve different functions in a variety of settings. There is potential for widespread creative application of the invention.

While our description cites many specifics, these do not limit the full scope of the invention, but relate to the preferred embodiments thereof. Although simulations introduced in the specification represent certain modes of transportation and animals, the identity chosen for the lead character could effectively simulate things growing from the earth like flowers, fruits or vegetables. Other lead character simulations could encompass a theme, collection, stage in history, an occupation, seasons, holidays, culture, outer space, sea life or other scientific areas. Moreover, the toy could reflect monsters, aliens, ghosts and other paranormal identities on an entertaining level. With the appropriate permissions, it is foreseeable that protected trademark and copyright character properties belonging to Disney, Sesame Street, Warner Brothers and Nickelodeon or other similar character references could function within the realm of the group walking toy. The color, size, texture and material of the elements of the invention will range as far as demand and creativity dictates. All colors are foreseeable. Sizes are adaptable according to need. Although there are five compartments in the preferred embodiment, it is anticipated that a slightly fewer or greater number of compartments will not effect the overall utility of the invention. It is anticipated that ways to shorten or lengthen the separate compartments could include fastening and releasing means for placing the anterior arms in a more forward or backward place within the frame. The components of the actual frame could be telescoping or even comprise pre-constructed interlocking compartments. The assurance of an unobstructed overhead and peripheral visual field for the users is necessary, excluding the space occupied by a participant immediately anterior to another participant. Texture and materials that are harmless should be used. Textures that depict the unique quality inherent in the chosen identity of the toy are anticipated when practical.

As previously discussed, the materials of the preferred embodiments are amply compressible to cushion an unpredictable stumble of a smaller school age or preschool age child. However, some sturdier materials recommended by toy safety associations for this type of product, could be used when manufacturing the group walking toy for older users or in less supervised settings. The lead characters are situated in front of the invention to act as a leader for the mobile group as well as to guide the context of the dramatic play. It is foreseeable however, that the lead character or dominating personality could be positioned elsewhere within the invention and still guide the context of the dramatic play. The means for securing and removing the lead characters are anticipated to include any variety of fasteners capable of attaching and releasing the lead characters to and from the frame respectively. Other handles or means of carrying the group walking toy are anticipated. The cutout handles of the preferred embodiment are basic yet more complex types such as telescoping, integrally attached or swing-away styles are possible. Handles comprising the subject matter of the lead character are envisioned as well. The users of the group walking toy may participate in any theme-related activities such as donning accessories like an engineer's cap when the invention simulates a train. Likewise, singing songs and saying phrases related to the identity of the group walking toy is suggested to enhance the playful experience, with or without the switch activated device. Although the switch device is located on the lead character in the preferred embodiment to produce sounds and/or phrases, it is anticipated that additional switch activated sensory stimulation features in other locations on the invention could enhance the total playful experience. For example, a fine mist spray for a simulated boat, a vibration for a simulated airplane or an aroma diffuser for a simulated flower garden would compliment the playful drama with the group walking toy.

Thus, the scope of the group walking toy should not be limited to the particular figures addressed, but should be determined by the claims and their equivalents.

What is claimed is:

1. A mobile toy comprising a plurality of compartments for containing persons, at least some of which of which are sized to contain a walking child, each compartment being defined by a sidewall structure having a side opening for ingress and egress, each of said compartments being open at a top and at a bottom, said toy being provided with means for suggesting an identity that stimulates a child's interest and means for utilizing walking energy of persons within the compartments to cause the toy to move.

2. The mobile toy of claim 1 wherein at least one of the compartments is large enough to contain an adult.

3. The mobile toy of claim 2 wherein the center of gravity of the toy passes through a compartment large enough to contain an adult.

4. The mobile toy of claim 1 wherein the compartments are aligned linearly so that persons within the compartments are aligned in single file.

5. The mobile toy of claim 1 wherein the means for utilizing walking energy of the children comprises a plurality of handles permitting the children to carry the toy with them as they walk.

6. The mobile toy of claim 1 wherein the means for suggesting an identity suggests a mobile object.

7. The mobile toy of claim 6 wherein the suggested object is an animal.

8. The mobile toy of claim 6 wherein the suggested object is a motorized vehicle.

9. The mobile toy of claim 1 wherein the means for suggesting an identity comprises an imaginative facsimile of an object.

10. The mobile toy of claim 9 wherein the imaginative facsimile of the object is located proximate a front end of the toy.

11. The mobile toy of claim 9 wherein the imaginative facsimile of the object can be altered to suggest different objects.

12. The mobile toy of claim 11 wherein the imaginative facsimile of the object is altered by exchange with a facsimile of a different object.

13. The mobile toy of claim 1 wherein means is provided for collapsing the toy for storage.

14. The mobile toy of claim 1 further comprises means for providing auditory stimulation related to the identity.

15. The mobile toy of claim 1 further comprises means for providing visual stimulation related to the identity supplemental to the means for suggesting the identity.

16. The mobile toy of claim 1 wherein the toy comprises lightweight shock absorbing materials.

17. The mobile toy of claim 16 wherein the toy further comprises readily cleanable surfaces.

18. The mobile toy of claim 1 wherein the toy has three through six compartments and is sufficiently light to permit the toy to be easily lifted and transported by children in the compartments.

19. The mobile toy of claim 1 wherein the toy has three through six compartments and is sufficiently light to permit the toy to be easily lifted and transported by an adult in a central compartment.

20. The mobile toy of claim 1 wherein the toy has a series of five through ten linearly lined compartments wherein first and last compartments of the series are sized to hold an adult.

* * * * *